United States Patent [19]

Perani

[11] 4,036,287

[45] July 19, 1977

[54] RADIATOR FOR HEATING PLANTS WITH ELEMENTS

[75] Inventor: Giuseppe Perani, Brescia, Italy

[73] Assignee: Fonderie F. IIi Perani S.p.A., Brescia, Italy

[21] Appl. No.: 545,217

[22] Filed: Jan. 29, 1975

[30] Foreign Application Priority Data

Feb. 1, 1974 Italy ..... 20683/74

[51] Int. Cl.[2] ..... F24H 9/04

[52] U.S. Cl. ..... 165/55; 165/129; 165/130; 165/175; 237/71

[58] Field of Search ..... 165/130, 175, 129, 55; 237/71

[56] References Cited

U.S. PATENT DOCUMENTS

| | | | |
|---|---|---|---|
| 452,828 | 5/1891 | Bond | 165/130 |
| 456,896 | 7/1891 | Joy | 165/130 |
| 1,605,949 | 11/1926 | Hildebrand | 165/130 |
| 1,975,957 | 10/1934 | Kuenstler | 165/130 |
| 2,752,125 | 6/1956 | Modine | 165/130 |
| 2,863,978 | 12/1958 | Young | 165/129 X |
| 3,426,840 | 2/1969 | Markowz | 165/129 |
| 3,867,981 | 2/1975 | Monroe | 165/55 |

FOREIGN PATENT DOCUMENTS

| | | | |
|---|---|---|---|
| 573,770 | 3/1958 | Belgium | 165/130 |
| 30,112 | 12/1912 | United Kingdom | 165/130 |
| 280,884 | 4/1928 | United Kingdom | 165/130 |

*Primary Examiner*—Carlton R. Croyle
*Assistant Examiner*—Edward Look
*Attorney, Agent, or Firm*—Dennis P. Clarke

[57] ABSTRACT

The radiator consists of a plurality of tubular elements A arranged side by side and in successive order to one another, said elements being connected at the lower and upper ends thereof.

Each element is made of a parallelipipedically shaped block, the upper end whereof is tapered, whilst wings 32 and and edges 22 are provided at the opposed faces of said block to engage head against head, in order to form, between the various elements, chimney-like ducts 28, the upper openings 36–38 whereof have a smaller cross section than the lower ones, in order to increase the circulation of hot air.

7 Claims, 5 Drawing Figures

RADIATOR FOR HEATING PLANTS WITH ELEMENTS

The present invention concerns a radiator for heating plants in general, consisting of elements arranged side by side, capable of defining chimney-shaped ducts for air circulation and exchange.

The purpose of the present invention is the embodiment of a radiator for heating plants in general, which is easy and practical to realize and to mount, allowing, at the same time, for a considerable heat exchange with the surrounding air.

Another purpose on the present invention is the embodiment of a radiator, the elements of which are easy to assemble, to form batteries of the desired capacity, which are advantageously, thought not exclusively realizable, even by means of die-casting, with aluminum and/or with aluminum alloys.

The radiator object of the invention, which is made of a plurality of tubular elements, hydraulically connected to each other by means of upper and lower pipe fittings, is characterized in that each of said elements consists of a hollow, substantially parallelepipedic block with a tapered top, such block being provided, along the edges of its surfaces, with co-planar, upright and alignable wings which can be aligned, head against head, with the wings of adjacent elements, so as to form, in such a way, between the above mentioned elements of the chimney-like ducts, upper openings, whilst the upper openings of said ducts have a minor cross-section than those of the lower ones, such openings being defined by said tapered ends of the aforesaid elements, to increase the circulation of hot air.

According to the invention, the upper part of the chimney-like ducts is defined by frustrum of ogive shaped bodies, formed with the curved ends of the coplanar upright wings, such bodies having openings provided with grids.

The annexed drawing shows, by way of example, an advantageous form of embodiment of the radiator object of the present invention, wherein.

Figure 2:
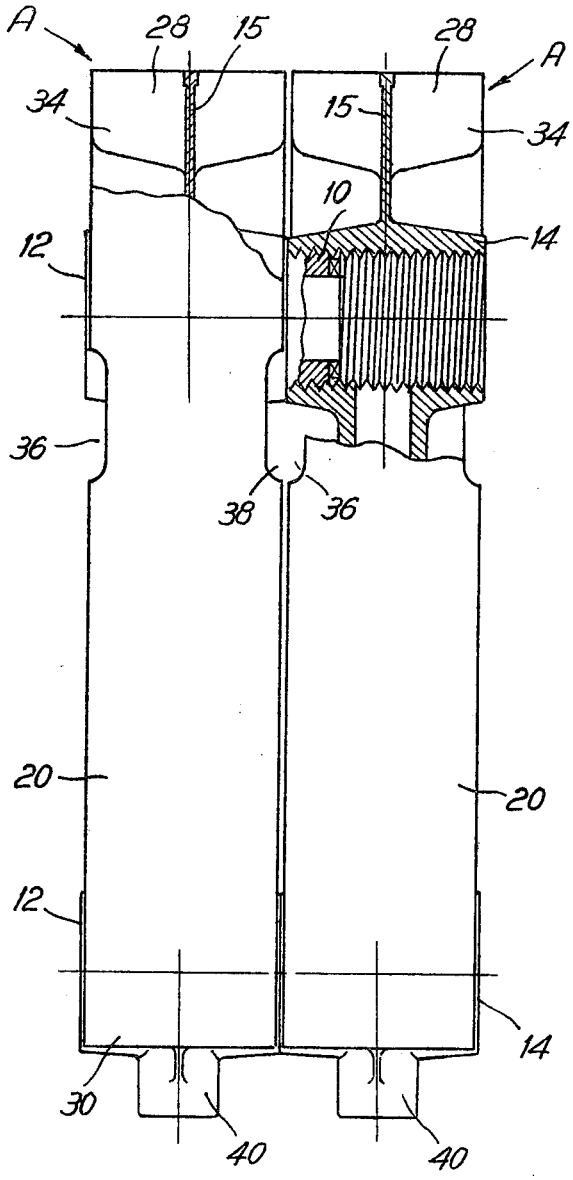
FIG. 2 shows, on an enlarged scale with parts cut away, two adjacent elements of the radiator according to FIG. 1.
Figure 5:
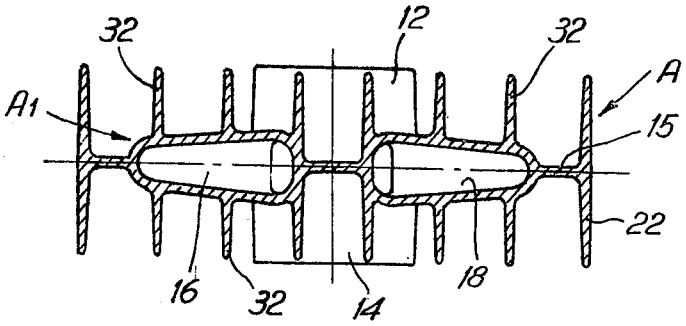
Figure 3:
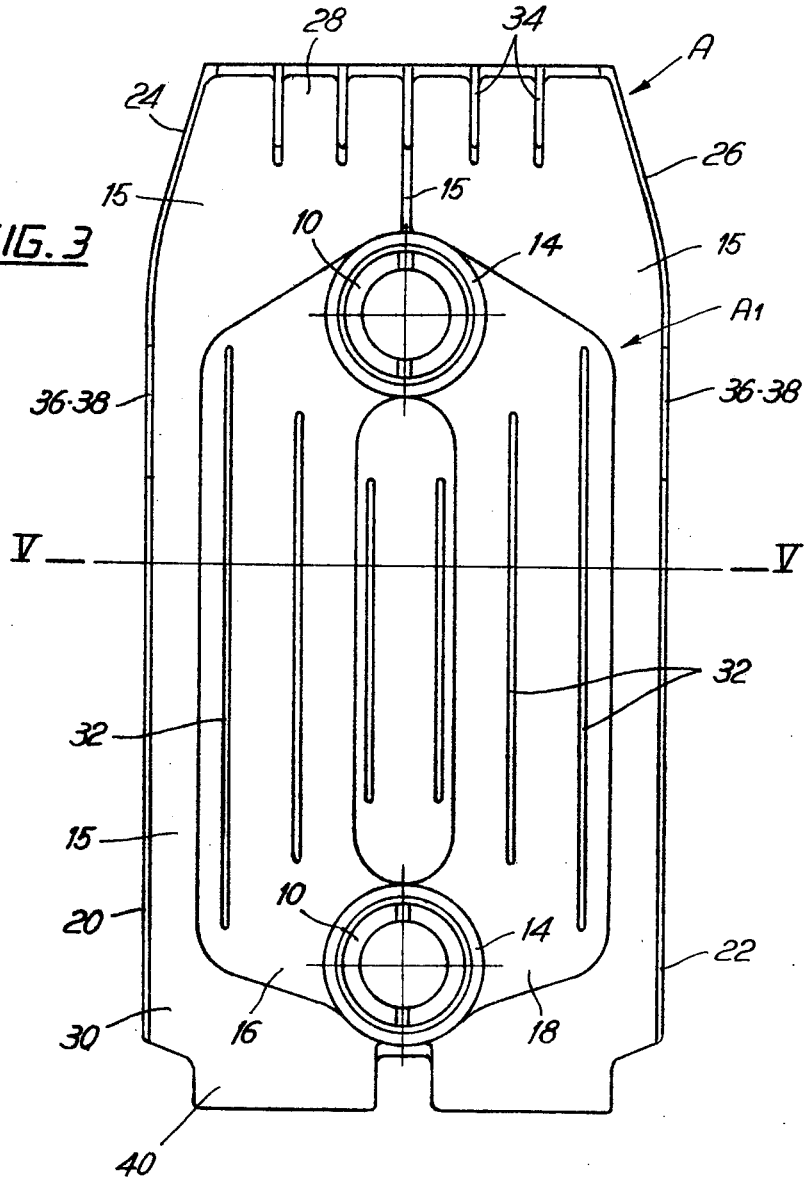
Figure 4:
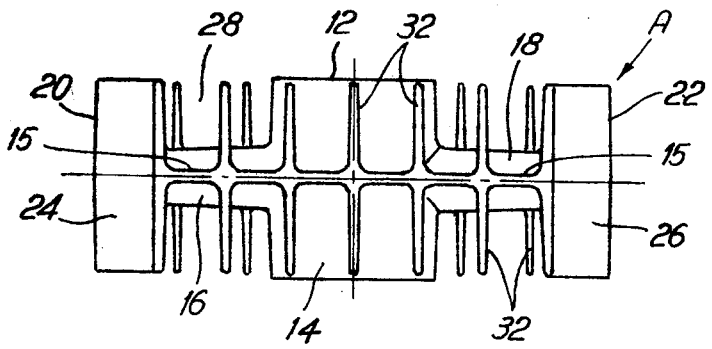

FIG. 3 in an end view of the radiator according to FIG. 2;

FIG. 4 shows the ground plane of the radiator;

FIG. 5 is a section along line V—V of FIG. 3.

The illustrated radiator consists of a plurality of similar elements A, disposed sideways to one another, said elements being both hydraulically and mechanically connected to each other by means of threaded ferrules 10, screwed into matching pipe fittings 12 and 14, provided sideways to and toward the upper and the lower end of each element.

Each of the pipe fittings 12 and 14 is hydraulically connected, at the middle part thereof, with the upper and the lower end respectively of two vertical ducts 16 and 18, provided by an upright plate 15.

The longitudinal edges of said plate 15 terminate with opposed and coplanar wings 20-22, said wings extending horizontally over a certain length, to form a substantially parallelepipedic hollow block, to house, in its middle part, plate 15 and the pipe fittings 12 and 14.

The edges of the opposed wings 20 and 22 cooperate, head against head, with the edges of the opposed wings which belong to the elements which are adjacent to the above mentioned element. Said opposes wings form coplanar, vertical surfaces, to build the front and rear walls of the radiator.

The upper part of the opposed wings 20 and 22 is shaped, with ogivally curved lengths 24 and 26. The upper ends of the opposed and coplanar wings 20 and 22 are forming, together with the matching parts of the adjacent elements, a rectangular opening 28, the through section whereof is substantially smaller than the matching opening 30, formed with the lower ends of the coplanar wings 20 and 22 of the aforementioned elements.

It is thus possible to realize, between the two adjacent elements A, a chimney-like duct A1, the lower opening whereof has a larger through section that the upper through section 28, to consent an increase of the heat exchange between the surrounding air and the radiator.

To further ensure an increase, of the heat exchange, the surfaces of the tubular plate 15, designed to form the walls of the chimneylike duct A1, are provided with vertical ribs 32, which are advantageously projecting into said chimney-like duct, to form parallel extending ducts, designed to ensure an even conveyance of the hot air in the direction of the delivery opening 28.

The upper opening is provided with a grid which forms a carrying level, shown above the radiator. In the illustrated case, said grid is formed with the upper extension of plate 15 retaining, at the upper part thereof, upright transversal wings 34 to form, at the opening 28, a characteristic gridlike structure.

As the upper edges of tubular plate 15, of the curved ends 24, 26, of the opposed wings 20, 22 and of the transversal wings 34 are coplanar, said parts are forming, in the upper part of the radiator element, a grid-like level, which can be utilized to put any desired object onto it, to heat such object by means of the hot air which is circulated through the vertical ducts $A_1$.

The opposed wings 20 and 22 have, toward the top thereof and below the ogivelike shaped lenghts 24–26, notches 36 and 38 to form, together with the matching notches of the adjacent elements, elongated openings (likewise designed with 36–38), to connect the chimney-like openings A1 with the ambient.

The tubular plate 15 of element A ends, at the lower side thereof, with small parallelepipedic blocks 40, which form a supporting basis for said element A and which define opening 30. The cold ambient air flows through the lower opening 30, into the chimneylike ducts A1 of the radiator and then, while said air is heated, through said chimney, in upward direction, till it meets the ogivated lengths 24 and 26, whereafter the speed of said air-stream increases to flow, through openings 36 and 38 and through opening 28 provided with a grid, into the ambient air.

Figure 1:
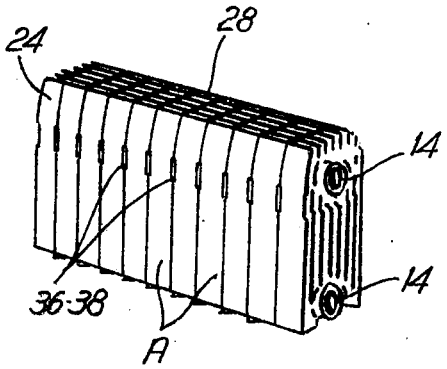
FIG. 1 is a perspective view of the radiator.

It is remaining understood that the radiator shown in FIG. 1 can be equipped, at the ends thereof, with plates designed to close the half-chimneys A1 formed at said ends from the first to the last of elements A the radiator is formed with.

I claim:

1. A radiator for heating plants consisting of a plurality of tubular elements arranged side by side and in successive order, said tubular elements being mechanically connected and hydraulically connected to each other by means of upper and lower lateral connections wherein each of said tubular elements consists of a hollow tubular plate housed in a substantially parallelepipedically shaped block with a tapered open top and an open bottom, said block being provided, at the edge of its faces, with upright coplanar wings alignable head against head with the wings of the adjacent elements to form, between said elements, chimneylike ducts, the upper openings of which have a smaller cross-section than the lower openings to increase the circulation of hot air, and side upper openings being defined by matching notches in the edges of said coplanar wings to further increase the circulation of hot air.

2. A radiator as claimed in claim 1, characterized in that each of its said elements has at the ends thereof, the connecting ducts for the adjacent elements and, at its periphery, the said upright coplanar wings.

3. A radiator as claimed in claim 1, characterized in that the upright coplanar wings of each element form tapered upper ends having arch-shaped, ogivated frustrum of cone shaped lengths, whilst said upper ends terminate with the said upper opening.

4. A radiator as claimed in claim 1, characterized in that the upright coplanar wings have notches in the neighborhood of the larger basis of the frustrum of ogive shaped body, said notches defining, together with those of the adjacent elements, openings designed to connect the chimneylike duct with the outside.

5. A radiator as claimed in claim 1, characterized in that the inner walls of the chimneylike duct are provided with ribs which extend into said ducts.

6. A radiator as claimed in claim 5, characterized in that the edges of said ribs cooperate, substantially head against head, with the ribs of the adjacent elements, to form parallel ducts.

7. A radiator as claimed in claim 1, characterized in that at least part of the said ribs extend almost to the neighborhood of the ogivated body, in order to form a grid, as well as a first support level.

* * * * *